US005451481A

United States Patent [19]

Law et al.

[11] Patent Number: 5,451,481

[45] Date of Patent: Sep. 19, 1995

[54] TONER AND DEVELOPER WITH MODIFIED SILICA PARTICLES

[75] Inventors: Kock-Yee Law, Penfield; Ihor W. Tarnawskyj, Webster, both of N.Y.

[73] Assignee: Xerox Corporation, Stamford, Conn.

[21] Appl. No.: 234,076

[22] Filed: Apr. 28, 1994

[51] Int. Cl.[6] ..... G03G 9/097
[52] U.S. Cl. ..... 430/110
[58] Field of Search ..... 430/110

[56] References Cited

U.S. PATENT DOCUMENTS

| | | | |
|---|---|---|---|
| 2,657,149 | 10/1953 | Iler et al. | 106/308 |
| 3,590,000 | 6/1971 | Palermiti et al. | 430/110 |
| 4,560,635 | 12/1985 | Hoffend et al. | 430/106.6 |
| 4,973,540 | 11/1990 | Machida et al. | 430/110 |
| 5,202,209 | 4/1993 | Winnik et al. | 430/110 X |
| 5,256,514 | 10/1993 | Law et al. | 430/106.6 |

FOREIGN PATENT DOCUMENTS

| | | | |
|---|---|---|---|
| 7846 | 1/1986 | Japan | 430/110 |
| 302268 | 12/1989 | Japan | 430/110 |
| 165250 | 7/1993 | Japan . | |

OTHER PUBLICATIONS

Proceedings of the Academy of Sciences, U.S.S.R. Phys. Chem. Engl. Transl., pp. 114, 421, (1957).
Handbook of Imaging Materials, pp. 169, 1991, edited by A. S. Diamond.
The Chemistry of Silica, R. K. Iler, p. 654, 1979.
Esterification of the Surface of Amorphous Silica, C. C. Ballard et al., vol. 65, pp. 20–25.

*Primary Examiner*—Roland Martin
*Attorney, Agent, or Firm*—E. O. Palazzo

[57] ABSTRACT

A toner composition comprised of resin, pigment, optional charge additive and a hydrophobic flow aid surface additive comprised of grafted alcoholic silicas.

33 Claims, No Drawings

TONER AND DEVELOPER WITH MODIFIED SILICA PARTICLES

BACKGROUND OF THE INVENTION

The invention is generally directed to toner and developer compositions, and more specifically, the present invention is directed to developer and toner compositions containing modified, for example the grafting of alcohol, aliphatic or aromatic alcohols on colloidal silica particles, and which particles can be selected for toners with rapid admix, excellent flow, and acceptable triboelectrical characteristics. In embodiments, there are provided in accordance with the present invention toner compositions comprised of resin particles, pigment particles, optional charge additives such as quaternary ammonium hydrogen bisulfates, including distearyl methyl hydrogen ammonium bisulfates; distearyl dimethyl ammonium methyl sulfate; alkyl pyridinium halides; metal complexes such as aluminum complexes, reference U.S. Pat. No. 4,845,003, the disclosure of which is totally incorporated herein by reference; TRH, reference U.S. Pat. Nos. 4,758,493 and 4,433,040, the disclosures of which are totally incorporated herein by reference; and, more specifically, 3,5-di-tertiary-butylsalicylic acid, and its salts; BONTRON E-82 TM; BONTRON E-84 TM; BONTRON E-88 TM; halogenated salicylic acids; LR 120 TM, available from Carlit Inc. of Japan, and the like; and modified silica particles. The silica particles can be modified by a process which comprises the reaction thereof with components that will, for example, reduce and regulate the moisture content thereof enabling the generation of a higher negative toner tribo, especially a higher tribo at 80 percent relative humidity, and a toner with improved relative humidity resistivity as compared to toners wherein untreated colloidal silica, or hydrophobic silicas commercially available are selected. In embodiments, a number of alcohols can be selected for treating and reacting with the silica surface. Examples of alcohol reactants include aliphatic alcohols, wherein aliphatic is preferably alkyl with from 4 to about 30 carbon atoms. Toners with the aforementioned treated surface additives in embodiments of the present invention possess rapid admix of less than about one minute, extended developer life, stable electrical properties, high image print quality with substantially no background deposits, and improved insensitivity to relative humidity of, for example, from 20 to 80 percent RH. Also, the aforementioned toner compositions usually contain pigment particles comprised of, for example, carbon black, magnetites, or mixtures thereof, cyan, magenta, yellow, blue, green, red, or brown components, or mixtures thereof, thereby providing for the development and generation of black and/or colored images. The toner compositions of the present invention in embodiments thereof possess excellent admix characteristics as indicated herein, and maintain their triboelectric charging characteristics for an extended number of imaging cycles exceeding, for example, 1,000,000 in a number of embodiments. The toner and developer compositions of the present invention can be selected for electrophotographic, especially xerographic, imaging and printing processes, including full color processes and trilevel color processes.

In embodiments of the present invention, the grafted alcoholic silicas can be selected as toner charge additives, toner flow aid additives, and the like. When selected as charge additives, a second known charge additive may also be present. The grafted alcoholic silicas of the present invention can be prepared similar to the process as illustrated in a paper by C. C. Ballard et al. entitled *Esterification Of The Surface Of Amorphous Silica, Journal of Physical Chemistry,* 65, 20 (1961), the disclosure of which is totally incorporated herein by reference. A similar disclosure is presented in U.S. Pat. No. 2,739,074, the disclosure of which is totally incorporated herein by reference. More specifically, the '074 patent discloses inorganic silicate materials having chemically bonded to the silicon atoms on the surface at least 100 OR groups wherein R is a substituted hydrocarbon radical in which the carbon attached to the oxygen is also attached to at least one hydrogen.

There is illustrated in U.S. Pat. No. 2,657,149, the disclosure of which is totally incorporated herein by reference, an estersil, which is organophilic and preferentially wetted by butanol. Other patents of interest relating to silicas that have been treated include U.S. Pat. Nos. 2,739,075; 2,739,076; 2,739,077; 2,739,078; 3,393,155, and 2,757,098, the disclosures of which are totally incorporated herein by reference.

Illustrated in *The Chemistry Of Silica,* R. K. Iler, John Wiley and Sons, page 464, 1979, is the adsorption of alcohols, such as hexyl alcohol, from carbon tetrachloride on the surface of silicas that were dehydroxylated. In *The Handbook Of imaging Materials,* edited by Arthur S. Diamond, page 169, 1991, it is indicated that good flow properties are usually desired and often are critical for toners and that materials such as fumed silicas can be added to the surface of a toners to improve flow, and can improve charge stability of the toner and carrier mixture.

Developer compositions with colloidal silica surface components and charge enhancing additives, which impart a positive charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchlorate, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide, reference the Abstract of the Disclosure and column 3; a similar teaching is presented in U.S. Pat. No. 4,312,933; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition and AEROSIL ® surface additives. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds and AEROSIL ® surface additives. Additionally, other documents disclosing positively charged toner compositions with charge control additives and AEROSIL ® surface additives include U.S. Pat. Nos. 3,944,493; 4,007,293; 4,079,014; 4,394,430, and 4,560,635, which illustrates a toner with a distearyl dimethyl ammonium methyl sulfate charge additive. One disadvantage associated with the charge additive of the '635 patent resides in its apparent inherent instability in some instances thus rendering it substantially unsuitable as a bulk toner constituent in imaging processes, as the additive can thermally and chemically degrade, and react with other toner components.

Toner compositions with negative charge enhancing additives and surface additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives. Toners with colloidal silica surface additives are illustrated in U.S. Pat. Nos. 3,590,000 and 3,800,588, the disclosures of which are totally incorporated herein by reference. Also, U.S. Pat. Nos. 5,256,514 and 5,256,575 illustrate negatively charged toners with certain charge additives adsorbed on silica surfaces. The disclosures of each of the aforementioned patents are totally incorporated herein by reference.

Illustrated in copending patent application U.S. Ser. No. 234,074 the disclosure of which is totally incorporated herein by reference, and filed currently herewith is a toner composition comprised of resin, pigment charge additive and a flow aid surface additive comprised of silica of a size diameter of from about 5 to about 40 nanometers, and which silica has been treated with a long chain alcohol. With the present invention, the silica is not merely treated or coated with an alcohol it is grafted thereto by a chemical reaction enabling, for example, a higher toner tribo at high relative humidity, for example 80 percent. Further, in U.S. Pat. No. 5,397,667, the disclosure of which is totally incorporated herein by reference, there is illustrated a negatively charged toner composition comprised of resin, pigment, optional negative inducing charge additive and a flow aid surface additive comprised of metallized hydrophobic silica of a size diameter of from about 5 to about 40 nanometers, and which silica contains adsorbed on its surface a hydrocarbon layer originating from a long chain aliphatic alcohol.

SUMMARY OF THE INVENTION

Examples of objects of the present invention follow:

It is an object of the present invention to provide toner and developer compositions and processes thereof.

In another object of the present invention there are provided positively, or negatively charged toner compositions useful for the development of electrostatic latent images including color images.

In yet another object of the present invention there are provided improved toner compositions containing grafted colloidal silica like AEROSIL ®, particles, and wherein the toners possess resistance to relative humidity, and improved, or reduced toner relative humidity sensitivity; and excellent flow characteristics.

In yet another object of the present invention there are provided toners with charge additives comprised of grafted alcoholic silicas.

Additionally, in yet another object of the present invention there are provided toners with first charge additives comprised of grafted alcoholic silicas, and second known charge additives like 3,5-di-tertiary salicyclic acid, BONTRON E-84 TM, BONTRON E-88 TM available from Orient Chemicals of Japan, and the like.

Moreover, in another object of the present invention there are provided toners with hydrophobic surface flow aid additives comprised of grafted alcoholic silicas.

Also, in another object of the present invention there are provided developer compositions containing the toners illustrated herein and with hydrophobic alcoholic grafted silica, or AEROSIL ® particles.

In yet a further object of the present invention there are provided improved humidity insensitive, from about, for example, 20 to 80 percent relative humidity at temperatures of from 60° F. to 80° F. as determined in a relative humidity testing chamber, toner compositions with desirable admix properties of from about 5 seconds to about 60 seconds as determined by the charge spectrograph, and preferably less than 15 seconds for example, and more preferably from about 1 to about 14 seconds, and acceptable triboelectric charging characteristics of from about 10 to about 40 microcoulombs per gram.

Another object of the present invention resides in the formation of toners which will enable the development of images in electrophotographic imaging apparatuses, which images have substantially no background deposits thereon, are substantially smudge proof or smudge resistant, and, therefore, are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of resin particles, pigment particles, optional charge enhancing additives, and grafted silica particles. In embodiments, the present invention is directed to toner compositions comprised of resin particles, pigment, optional charge additives and surface hydrophobic flow aid additives of alcoholic silicas. Also, in embodiments the present invention is directed to toner compositions comprised of resin particles, pigment, first charge additives comprised of alcoholic grafted silicas and second known charge additives.

Alcoholic grafted silicas refers in embodiments to silicas, such as the AEROSILS® available from DeGussa Inc., which have been grafted with alcohols, such as aliphatic or aromatic alcohols and especially aliphatic alcohols with about 4 to about 40, and preferably from about 8 to about 30 carbon atoms, or aromatic alcohols with from 6 to about 30 carbon atom. Examples of alcohols that can be selected include butanol, pentanol, heptanol, hexanol, octanol, decanol, dodecanol, tetradecanol, hexadecanol, octadecanol, eicosanol, docosanol, 4-tertiary-butylcyclohexanol, 4-octylphenol 1H,1H,2H,2H-perfluorododecanol, 4-tertiary-butylphenol, 3,5-di-tertiary-butylphenol, nonylphenol, 2-butyl-1-octanol, 2-pentyl-1-nonanol, di-undecylcarbinol isomers thereof, and phenol, phenol derivative containing hydrocarbon groups with a length of 4 to 24 carbon atoms, such as nonyl phenol, and the like. The alcohol can be selected as a single component or, for example, 1:1 mixture with hydrocarbons such as hexadecane. The grafting reaction is usually accomplished by heating, including heating a mixture of, for example, a 1:1 alcohol to hexadecane, thereof at a temperature of from about 100° C. to about 400° C., and preferably from about 150° C. to about 350° C. With the present invention, there is primarily selected fumed silicas with an average volume diameter of from about 5 to 40 and preferably about 6 to about 20 nanometers, and not silica gels.

In embodiments, the process of the present invention comprises adding the alcohol grafted silica to a hydrocarbon solution containing an alcohol. Various hydrocarbon solutions can be selected such as solutions of pentane, hexane, heptane, octane, cyclopentane, cyclohexane, mixtures thereof, and the like. Small effective amounts of other components, such as ethers in an amount of, for example, 0.3 weight percent, can be added to assist in the solubility of the alcohol in the coating solution.

The known charge additives present in various effective amounts, such as from about 0.1 to about 5 weight percent, include hydrogen ammonium bisulfate charge enhancing additives such as distearyl methyl hydrogen ammonium bisulfate, trimethyl hydrogen ammonium bisulfate, triethyl hydrogen ammonium bisulfate, tributyl hydrogen ammonium bisulfate, didodecyl methyl hydrogen ammonium bisulfate, dihexadecyl methyl hydrogen ammonium bisulfate, and the like. When a mixture of charge additives are selected, from about 0.005 to about 3 of the aforementioned known charge additives and from about 0.1 to about 5 weight percent of the grafted alcoholic silicas of the present invention can be selected. The grafted alcohol range present on the surface of the silica is from about 0.5 to about 20 and preferably from about 4 to about 20 weight percent.

In another embodiment of the present invention there is provided, subsequent to known micronization and classification, to enable toner particles with an average volume diameter of from about 4 to about 20 microns.

The toner compositions of the present invention can be prepared by a number of known methods, such as admixing and heating resin particles such as styrene butadiene copolymers, polyesters like SPAR TM and crosslinked polyesters as illustrated in U.S. Pat. No. 5,227,460, the disclosure of which is totally incorporated herein by reference, pigment particles such as magnetite, carbon black, or mixtures thereof, preferably from about 0.5 percent to about 5 percent of charge enhancing additives, or mixtures of charge additives in a toner extrusion device, such as the ZSK53 available from Werner Pfleiderer, and removing the formed toner composition from the device followed by the addition of the alcoholic grafted silica particles illustrated herein. Subsequent to cooling, the toner composition is subjected to grinding utilizing, for example, a Sturtevant micronizer for the purpose of achieving toner particles with a volume median diameter of less than about 25 microns, and preferably of from about 4 to about 12 microns, which diameters are determined by a Coulter Counter. Subsequently, the toner compositions can be classified utilizing, for example, a Donaldson Model B classifier for the purpose of removing fines, that is toner particles less than about 2 microns volume median diameter.

Illustrative examples of suitable toner resins selected for the toner and developer compositions of the present invention include polyesters, especially the extruded crosslinked polyesters of U.S. Pat. No. 5,376,494, polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof; and the like, styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers, of the aforementioned styrene polymers may be selected.

One typical toner resin is the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 6,000, such as polyethylene, polypropylene, and paraffin waxes, can be included in, or on the toner compositions as fuser roll release agents. The polyesters of U.S. Pat. No. 5,376,494 and U.S. Pat. No. 5,227,460 (D/91117Q), the disclosures of which are totally incorporated herein by reference, and other linear and branched polyesters can also be selected.

The resin particles are present in a sufficient, but effective amount, for example from about 70 to about 90 weight percent. Thus, when 0.5 percent by weight of the charge enhancing additive is present, and 8 percent by weight of pigment or colorant, such as carbon black, is contained therein, about 91.5 percent by weight of resin is selected. The grafted silica particles when functioning as flow aids are usually added to the toner in various effective amounts of from about 0.1 to about 7 and preferably from about 0.1 to about 2 weight percent.

Numerous well known suitable pigments or dyes can be selected as the colorant for the toner particles including, for example, carbon black like REGAL 330®, and other carbon blacks available, for example, from Cabot Corporation, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition.

When the pigment particles are comprised of magnetites, thereby enabling single component toners in some instances, which magnetites are a mixture of iron oxides ($FeO.Fe_2O_3$) including those commercially available as MAPICO BLACK TM, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK TM, in an amount of, for example, from about 5 to about 60, and preferably from about 10 to about 50 weight percent can be selected.

There are blended with the toner compositions of the present invention external grafted silica flow aid additive particles which additives are usually present on the surface thereof. Examples of further additives include metal salts and metal salts of fatty acids inclusive of zinc stearate, aluminum oxides, cerium oxides, cesium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, the grafted colloidal silicas can be surface treated with the negatively charge inducing charge additives illustrated herein in an amount of from about 0.1 to about 2 weight percent and preferably about 0.5 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, optional carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black in an amount of from about 5 to about 30 percent by weight. Polymer coatings not in close proximity in the triboelectric series can also be selected, reference copending applications U.S. Pat. No. 4,937,166 and U.S. Pat. No. 4,935,326, the disclosures of which are totally incorporated herein by reference, including, for example, KYNAR® and polymethylmethacrylate mixtures (40/60). Coating weights can vary as indicated herein; generally, however, from about 0.3 to about 2, and preferably from about 0.5 to about 1.5 weight percent coating weight is selected. A preferred carrier is comprised of a 90 micron diameter steel core with a coating thereover of 80 percent of polymethylmethacrylate and 20 percent of a carbon black, such as REGAL 330®, and wherein the coating weight is about 1 percent.

Furthermore, the diameter of the carrier particles, preferably spherical in shape, is generally from about 50 microns to about 1,000, and preferably from about 60 to about 200 microns thereby permitting them to possess sufficient density and inertia to avoid adherence to the electrostatic images during the development process. The carrier component can be mixed with the toner composition in various suitable combinations, such as from about 1 to about 5 parts per toner to about 100 parts to about 200 parts by weight of carrier are selected.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Examples of photogenerating pigments include perylenes, like BZP, trigonal selenium, and the like. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable.

The toner compositions are usually jetted and classified subsequent to preparation to enable toner particles with a preferred average diameter of from about 4 to about 25 microns, and more preferably from about 4 to about 12 microns. Also, the toner compositions of the present invention preferably possess a triboelectric charge of from about a negative 10 to about a negative 50 microcoulombs per gram and preferably from about −10 to about −35, in embodiments thereof as determined by the known charge spectograph. Admix time for the toners of the present invention in embodiments are preferably from about 5 seconds to 2 minutes, and more specifically from about 5 to about 1 minute in embodiments thereof as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

The following Examples are being supplied to further define various species of the present invention, it being noted that these Examples are intended to illustrate and not limit the scope of the present invention. Parts and percentages are by weight unless otherwise indicated.

EXAMPLE I

A hydrophilic silica A130® (3 grams, obtained from Degussa Chemicals, 16 nanometers diameter) was activated in a furnace at about 600° C. for 3 to 4 hours. It was then transferred to a 250 milliliters three neck flask containing a mixture of 1-dodecanol, about 50 milliliters, and n-hexadecane, about 50 milliliters. The resulting dispersion was heated to a bath temperature of 260° C. to 280° C. for 16 hours under a nitrogen atmosphere. The resulting silica product was cooled to room temperature and was isolated by filtration. After washing thoroughly with methanol to remove all high boiling solvents, such as residual 1-dodecanol and n-hexadecane, the solid obtained was dried in a vacuum oven overnight at ~70° to 80° C. A hydrophobic alcohol grafted silica was obtained, ~3.3 grams. Hydrocarbon chains were detected on the hydrophobic alcohol grafted silica product by IR spectroscopy and the grafted alcohol could not be removed by washing with methanol indicating the alcohol was grafted and not adsorbed.

The silica product was then transferred to a 4 ounce bottle and roll milled with 35 grams of ¼ inch steel shot for 30 minutes at a speed of 90 feet/minute, yielding a fluffy white powder. This alcohol-grafted silica (0.063 gram), 9 μm (average volume diameter) unpigmented SPAR II™ polyester toner (12.5 grams) and 125 grams of ¼ inch steel shot were ethoxy laced inside a 4 ounce bottle and was roll milled for 30 minutes, resulting in an experimental toner containing on the surface 0.5 weight percent of the alcohol-grafted silica.

Developers, one for 20 percent relative humidity, and one for 80 percent relative humidity, were prepared with the above toner (1.25 grams) and 60 grams of a steel core carrier (about 98 μm), 0.7 percent by weight of a surface coating of 20 percent carbon black and 80 percent poly(methyl methacrylate). The developers were conditioned, or placed inside a humidity controlled glove box at a constant RH (either 20 percent or 80 percent RH) overnight. They were then roll milled for 5 minutes at a speed of 90 feet/minute. The toner tribos were determined inside a Faraday Cage by the blow-off method. The results were:

| 20 PERCENT RH TRIBO | 80 PERCENT RH TRIBO |
|---|---|
| −32.4 μC/gram | −11.1 μC/gram |

EXAMPLE II

The processes of Example I were repeated with the exception that AEROSIL A300® (from Degussa Chemical, 7 nanometers diameter) was used in place of A130®. The toner tribo results were:

| 20 PERCENT RH TRIBO | 80 PERCENT RH TRIBO |
|---|---|
| −37.3 μC/gram | −15.0 μC/gram |

EXAMPLE III

The processes of Example I were repeated with the exception that AEROSIL A380® (from Degussa, 7 nanometers diameter) was used in place of A 130®. The toner tribo results were:

| 20 PERCENT RH TRIBO | 80 PERCENT RH TRIBO |
|---|---|
| −41.1 μC/gram | −15.6 μC/gram |

EXAMPLE IV

The processes of Example I were repeated with the exception that the AEROSIL A130® was activated at 900° C. instead of 600° C. The toner tribo results were:

| 20 PERCENT RH TRIBO | 80 PERCENT RH TRIBO |
|---|---|
| −35.3 μC/gram | −11.8 μC/gram |

COMPARATIVE EXAMPLE 1

Commercially available silicas, such a hydrophilic silica A130®, A300® and A380® obtained from Degussa, Inc., hydrophobic silicas R972® and R812® obtained from Degussa, Inc., and TS530™ obtained from Cabot Corporation were used to formulated toners and developers by repeating the processes of Example I. The toner tribo results were:

| SILICA | PARTICLE SIZE | TRIBO 20 PERCENT RH | TRIBO 80 PERCENT RH |
|---|---|---|---|
| A130® | 16 nanometers | −25.1 μC/gram | −1.9 μC/gram |
| A300® | 7 nanometers | −33.1 μC/gram | −6.1 μC/gram |
| A380® | 7 nanometers | −29.4 μC/gram | −5.8 μC/gram |
| R972® | 16 nanometers | −26.4 μC/gram | −4.9 μC/gram |
| R812® | 7 nanometers | −39.1 μC/gram | −11.4 μC/gram |
| TS530™ | 7 nanometers | −34.9 μC/gram | −13.0 μC/gram |

Comparison of the results indicates that toners with the alcohol-grafted silicas of the present invention and the same size consistently generate superior, for example higher tribos at 80 percent RH.

EXAMPLE V

The processes in Example I were repeated with the exception that a different alcohol reactant was used in place of 1-dodecanol. The alcohols were 1-butanol, 1-octanol, 1-hexadecanol, 1-octadecanol, 4-t-butylcyclohexanol, and 1H,1H,2H,2H-perfluorododecanol. The toner tribo results were:

| ALCOHOL REACTANT | 20 PERCENT RH TRIBO | 80 PERCENT RH TRIBO |
|---|---|---|
| 1-butanol | −28.6 μC/gram | −6.6 μC/gram |
| 1-octanol | −29.0 μC/gram | −7.1 μC/gram |
| 1-hexadecanol | −30.6 μC/gram | −10.5 μC/gram |

-continued

| ALCOHOL REACTANT | 20 PERCENT RH TRIBO | 80 PERCENT RH TRIBO |
|---|---|---|
| 1-octadecanol | −29.2 μC/gram | −10.9 μC/gram |
| 4-t-butylcyclohexanol | −29.7 μC/gram | −9.6 μC/gram |
| 1H,1H,2H-perfluorododecanol | −42.9 μC/gram | −10.1 μC/gram |

Improvements in tribos at both RHs are obtained as compared to R972®, a commercial hydrophobic silica of the same size.

EXAMPLE VI

The processes of Example I were repeated with the exception that aromatic alcohols were used in place of 1-dodecanol. The aromatic alcohols were 4-t-butylphenol, 3,5-di-t-butylphenol, 4-t-octylphenol and nonylphenol. The toner tribo results were:

| PHENOL REACTANT | 20 PERCENT RH TRIBO | 80 PERCENT RH TRIBO |
|---|---|---|
| 4-t-butylphenol | −30.7 μC/gram | −9.7 μC/gram |
| 3,5-di-t-butylphenol | −31.0 μC/gram | −10.6 μC/gram |
| 4-t-octylphenol | −30.6 μC/gram | −9.9 μC/gram |
| nonylphenol | −30.7 μC/gram | −10.9 μC/gram |

EXAMPLE VII

The grafted silica obtained in Example I, about 3.0 grams, was added into a solution containing 0.3 gram of 1-hexadecanol in 100 milliliters of n-hexane. After stirring for 2 hours, the hexane solvent was removed on an evaporator. The residue obtained was transferred to a crystallization dish and was dried in an oven overnight, about 18 hours, at 70° C. The resulting solid was then transferred to a 4 ounce bottle and roll milled with 35 grams of ¼ inch steel shot for 30 minutes at a speed of 90 feet/minute, yielding ~3.3 of a fluffy white modified silica comprised of about 10 weight percent of 1-hexadecanol adsorbed on the surface of the grafted silica. Toner and developers were then prepared according to the procedures in Example I. The toner tribo results were:

| 20 PERCENT RH TRIBO | 80 PERCENT RH TRIBO |
|---|---|
| −36.4 μC/gram | −17.1 μC/gram |

EXAMPLE VIII

The procedures in Example VII were repeated with the exception that the grafted silica in Example II was used. Two 1-hexadecanol coatings were prepared and the toner tribo results of the modified silicas were:

| SILICA TO 1-HEXADECANOL | 20 PERCENT RH TRIBO | 80 PERCENT RH TRIBO |
|---|---|---|
| 100:10 | −29.5 μC/gram | −17.1 μC/gram |
| 100:20 | −25.4 μC/gram | −19.8 μC/gram |

EXAMPLE IX

The processes of Example I were repeated with the exception that branched alcohols, such as 2-butyl-1-octanol, 2-penty-1-nonanol and diundecylcarbinol, were used in place of 1-dodecanol. The toner tribo results were:

| | 20 PERCENT RH TRIBO | 80 PERCENT RH TRIBO |
|---|---|---|
| 2-butyl-1-octanol | −31.5 μC/gram | −11.4 μC/gram |
| 2-pentyl-1-nonanol | −31.4 μC/gram | −13.4 μC/gram |
| diundecylcarbinol | −34.4 μC/gram | −12.6 μC/gram |

EXAMPLE X

The modified silica prepared in Example III, about 3.0 grams, was added into a solution containing 0.6 gram of 1-hexadecanol and 100 milliliters of n-pentane. The mixture was stirred under ultrasonication for 2 hours and then overnight. Solvent was then removed on an evaporator. The residue obtained was transferred to a crystallization dish and was dried in an oven overnight at 70° C. The resulting solid was then transferred to a 4 ounce bottle and roll milled with 35 grams of ¼ inch steel shot for 30 minutes at a speed of 90 feet/minute, yielding ~3.3 grams of a fluffy white modified silica with 20 weight percent of 1-hexadecanol adsorbed on a 7 nanometer size alcohol grafted silica. Toner and developers were then prepared according to the procedures in Example I. The toner tribo results were:

| 20 PERCENT RH TRIBO | 80 PERCENT RH TRIBO |
|---|---|
| −39.0 μC/gram | −16.4 μC/gram |

EXAMPLE XI

The processes of Example III were repeated with the exception that 2-pentyl-1-nonanol was used in place of 1-dodecanol in the grafting process. The tribos of the resulting toner were:

| 20 PERCENT RH TRIBO | 80 PERCENT RH TRIBO |
|---|---|
| −50.3 μC/gram | −17.4 μC/gram |

EXAMPLE XII

The modified silica with 8 weight percent of 2-pentyl-1-nonanol adsorbed on the grafted silica prepared in Example XI (~3.0 grams) was overcoated by 1-hexadecanol using the procedure in Example X. The toner tribos were:

| 20 PERCENT RH TRIBO | 80 PERCENT RH TRIBO |
|---|---|
| −44.6 μC/gram | −15.0 μC/gram |

EXAMPLE XIII

About 3 grams of an alcohol grafted silica prepared in Example I were suspended in 100 milliliters of methanol inside a 250 milliliter round bottom flask. The suspension was then neutralized by adding an aqueous solution of lithium hydroxide ($1\times10^{-3}$ N) until the reading in the pH meter is 7.0. The mixture was stirred for one hour and methanol solvent was removed by evaporation. The metallized silica was obtained after vacuum drying at 80° to 100° C. overnight. The solid was then transferred to a 4 ounce bottle and roll milled with 35 grams of ¼ inch steel shot for 30 minutes at a speed of 90 feet/minute, yielding ~3 grams of a fluffy white modified silica. Toner and developers were then prepared according to the procedure in Example I. The toner tribo results were:

| 20 PERCENT RH TRIBO | 80 PERCENT RH TRIBO |
|---|---|
| −32.3 μC/gram | −12.2 μC/gram |

EXAMPLE XIV

About 3 grams of the metallized silica prepared in Example XIII were overcoated with 0.3 gram of 1-hexadecanol in 100 milliliters of pentane using the conditions described in Example X. The toner tribo results were:

| 20 PERCENT RH TRIBO | 80 PERCENT RH TRIBO |
|---|---|
| −25.9 μC/gram | −14.7 μC/gram |

EXAMPLE XV

About 3 grams of an alcohol grafted silica prepared in Example II were neutralized by lithium hydroxide using the procedures in Example XIII. The toner tribo results of the metallized silica were:

| 20 PERCENT RH TRIBO | 80 PERCENT RH TRIBO |
|---|---|
| −39.9 μC/gram | −16.4 μC/gram |

EXAMPLE XVI

About 3 grams of the metallized silica in Example XV were overcoated with 0.6 gram of 1-hexadecanol in 100 milliliters of pentane using the conditions described in Example X. The toner tribo results of the modified silica were:

| 20 PERCENT RH TRIBO | 80 PERCENT RH TRIBO |
|---|---|
| −33.8 μC/gram | −16.8 μC/gram |

EXAMPLE XVII

There was prepared in an extrusion device, available as ZSK28 from Werner Pfleiderer, a toner composition by adding 95 percent of a crosslinked SPAR TM resin, 30 percent gel content, reference U.S. Pat. No. 5,227,460, the disclosure of which is totally incorporated herein by reference, and 5 percent of carbon black REGAL 330®. The toner product was melt extruded at ~160° C., jetted and classified to about 9 microns in average volume diameter. The modified grafted silicas of Examples XIV and XVI, 0.063 gram, were blended into the above black toner (12.5 grams) inside a 4 ounce bottle by roll milling the mixture with 125 grams of ¼ inch steel shot on a roll mill for 30 minutes.

Developers were then prepared using the prepared black toners (1.25 grams) and 60 grams of a ~98 μm steel core carrier of 1 percent of a surface coating of 20 percent carbon black and 80 percent PMMA. The developers were then placed inside a humidity controlled glove box at a constant RH (20 percent or 80 percent RH) for 16 to 20 hours. They were then roll milled for 30 minutes at a speed of 90 feet/minute. The toner tribos were then determined by the standard blow-off technique. The results were:

| | 20 PERCENT RH TRIBO | 80 PERCENT RH TRIBO |
|---|---|---|
| Modified Silica in Example XIV | −23.2 μC/gram | −13.6 μC/gram |
| Modified Silica in Example XVI | −27.0 μC/gram | −15.2 μC/gram |

COMPARATIVE EXAMPLE 2

The toner and the developer preparative procedures in Example XVII were repeated with the exception that a hydrophobic silica (16 nanometers, R972® from Degussa) was used in place of the modified silicas of the present invention. The toner tribo results were:

| | 20 PERCENT RH TRIBO | 80 PERCENT RH TRIBO |
|---|---|---|
| AEROSIL R972 ® | −23.7 μC/gram | −10.4 μC/gram |

Under the same conditions, the silicas in Example XVII is superior, particularly at 80 percent RH, primarily because of the higher tribo charge which enables a reduction in RH sensitivity for the toner.

EXAMPLE XVIII

There was prepared a yellow toner composition by repeating the process of Example XVII with the exception that the toner compositions were comprised of 87.5 percent SPAR TM polyester resin and 12.5 percent LUPRETON TM yellow. The toner was melt extruded, jetted and classified to about ~7 μm. Modified silicas prepared in Example XIV and Example XVI were blended into the above yellow toner (12.5 grams) inside a 4 ounce bottle by roll milling the mixture with 125 grams of ¼ inch steel shot on a roll mill for 30 minutes.

Developers were then prepared uwith ing the prepared yellow toner (4.02 grams) and 100 grams of a ~65 μm steel core carrier of a 1.6 percent surface coating of 20 percent carbon black and 80 percent PMMA. The developers were then evaluated as in Example XVII. The toner tribo results were:

| | 20 PERCENT RH TRIBO | 80 PERCENT RH TRIBO |
|---|---|---|
| Modified Silica in Example XIV | −30.5 μC/gram | −16.1 μC/gram |
| Modified Silica in Example XVI | −35.2 μC/gram | −20.0 μC/gram |

COMPARATIVE EXAMPLE 3

The toner and the developer procedures in Example XVIII were repeated with the exception that a hydrophobic silica (R972 ® obtained from Degussa Chemical) was used in place of the modified silicas of the present invention. The toner tribo results were:

| | 20 PERCENT RH TRIBO | 80 PERCENT RH TRIBO |
|---|---|---|
| AEROSIL R972 ® | −29.1 μC/gram | −11.2 μC/gram |

A significant improvement, that is the tribo variation between 80 percent RH and 20 percent RH, was relatively small.

Other modifications of the present invention may occur to those skilled in the art subsequent to a review of the present application, and these modifications, including equivalents thereof, are intended to be included within the scope of the present invention.

What is claimed is:

1. A toner composition consisting essentially of resin, pigment, charge additive and a flow aid surface additive comprised of a grafted aliphatic alcoholic silica; and wherein said aliphatic alcohol is grafted on said flow aid surface additive by heating a mixture of said flow aid surface additive in said aliphatic alcohol at a temperature of from about 100° to about 400° C.

2. A toner in accordance with claim 1 wherein the grafted alcoholic silica is of a diameter of from about 5 to about 40 nanometers.

3. A toner in accordance with claim 1 wherein the aliphatic alcohol has a carbon chain length of from about 4 to about 40 carbon atoms.

4. A toner in accordance with claim 1 wherein the aliphatic alcohol has a carbon chain length of from about 4 to about 30 carbon atoms.

5. A toner in accordance with claim 1 wherein the aromatic alcohol is a phenol derivative.

6. A toner in accordance with claim 1 wherein the alcohol is selected from the group consisting of butanol, pentanol, hexanol, heptanol, octanol, decanol, dodecanol, tetradecanol, hexadecanol, eicosanol, docosanol, 4-tertiary-butylcyclohexanol, 2-butyl-1-octanol, and di-undecylcarbinol.

7. A toner in accordance with claim 1 wherein the aliphatic alcohol is present in an amount of from about 2 to about 30 weight percent.

8. A toner in accordance with claim 1 wherein a charge additive is present.

9. A toner in accordance with claim 1 with a triboelectric value of from about −10 to about −50 microcoulombs per gram, and which toner is substantially insensitive to relative humidity in the range of 20 to 80 percent.

10. A toner in accordance with claim 1 wherein the resin is a styrene acrylate, a styrene methacrylate, a styrene butadiene, or a polyester.

11. A toner in accordance with claim 10 wherein the polyester is a crosslinked polyester.

12. A toner in accordance with claim 10 wherein the polyester is poly(proxylated bisphenol fumarate).

13. A toner in accordance with claim 1 wherein the pigment is selected from the group consisting of carbon black, magnetite, cyan, magenta, yellow, and mixtures thereof.

14. A toner in accordance with claim 1 wherein the charge additive is a metal complex.

15. A toner in accordance with claim 1 wherein the aliphatic alcohol is present in an amount of from about 4 to about 20 weight percent.

16. A toner in accordance with claim 1 further containing surface additives of metal salts of a fatty acid, or metal oxides.

17. A toner in accordance with claim 16 wherein said metal salts are zinc stearate, and said oxides are titanium dioxide, tin oxide, or silicon oxide present in an amount of from about 0.1 to about 3 weight percent.

18. A developer comprised of the toner of claim 1 and carrier particles.

19. A developer in accordance with claim 18 wherein the carrier is comprised of a metal core with a coating thereover.

20. A toner composition in accordance with claim 8 wherein the charge additive is present in an amount of from about 0.1 to about 3 weight percent.

21. A toner composition in accordance with claim 1 further containing a wax component with a weight average molecular weight of from about 1,000 to about 10,000.

22. A toner composition in accordance with claim 21 wherein the wax component is selected from the group consisting of polyethylene and polypropylene.

23. A toner composition consisting essentially of resin, pigment, first charge additive of a grafted aliphatic alcoholic silica and a second charge additive; and wherein said aliphatic alcohol is grafted to a silica flow aid surface additive, which grafting is accomplished by heating a mixture of said silica flow aid additive and said alcohol at a temperature of from about 100° to about 400° C.

24. A toner composition in accordance with claim 23 wherein the first charge additive is present in an amount of from about 0.05 to about 5 weight percent.

25. A toner composition in accordance with claim 24 wherein the aliphatic alcohol has a carbon chain length of from about 8 to about 30 carbon atoms.

26. A toner in accordance with claim 1 further including adsorbing an aliphatic alcohol with from about 12 to about 20 carbon atoms on the surface of the grafted alcoholic silicas.

27. A toner is accordance with claim 26 wherein the alcohol is hexadecanol and the amount ratio of the grafted silica to the hexadeconal is from about 100:5 to about 100:50.

28. A toner in accordance with claim 1 further including metallizing said grafted silica with a metal hydroxide, and subsequently adsorbing a hexadecanol layer on the surface thereof.

29. A toner in accordance with claim 1 wherein said heating is accomplished at a temperature of from about 150° to about 350° C.

30. A toner in accordance with claim 23 wherein said heating is accomplished at a temperature of from about 150° to about 350° C.

31. A toner in accordance with claim 1 wherein there are formed hydrocarbon chains on the alcohol grafted silica, and wherein said grafted alcohol could not be removed by washing with a solvent.

32. A toner in accordance with claim 31 wherein the solvent is methanol, and said alcohol is 1-dodecanol.

33. A toner in accordance with claim 1 wherein the alcohol is 1-hexadecanol, 2-butyl-1-octanol, or 1-dodecanol.

* * * * *